US010335818B2

(12) United States Patent
Pointel et al.

(10) Patent No.: US 10,335,818 B2
(45) **Date of Patent: *Jul. 2, 2019**

(54) DUAL DISPENSER

(71) Applicant: APTAR FRANCE SAS, Le Neubourg (FR)

(72) Inventors: Yannick Pointel, Epegard (FR); Alex Milian, Les Baux de Breteuil (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/758,570

(22) PCT Filed: Sep. 8, 2016

(86) PCT No.: PCT/FR2016/052240
§ 371 (c)(1),
(2) Date: Mar. 8, 2018

(87) PCT Pub. No.: WO2017/042492
PCT Pub. Date: Mar. 16, 2017

(65) Prior Publication Data

US 2018/0243770 A1 Aug. 30, 2018

(30) Foreign Application Priority Data

Sep. 9, 2015 (FR) ..... 15 58351

(51) Int. Cl.
*B05B 11/00* (2006.01)

(52) U.S. Cl.
CPC ..... *B05B 11/3084* (2013.01)

(58) Field of Classification Search
CPC ..... B05B 11/3004; B05B 11/3083; B05B 11/3007

(Continued)

(56) References Cited

U.S. PATENT DOCUMENTS 5,848,732 A * 12/1998 Brugger ..... B05B 11/3083 222/137
6,036,057 A 3/2000 Poutiatine (Continued)

FOREIGN PATENT DOCUMENTS

DE 39 11 089 A 10/1990
EP 1 433 533 A1 6/2004

(Continued)

OTHER PUBLICATIONS

International Search Report for PCT/FR2016/052240 dated Jan. 24, 2017 [PCT/ISA/210].

(Continued)

*Primary Examiner* — Jeremy Carroll
(74) *Attorney, Agent, or Firm* — Sughrue Mion, PLLC

(57) ABSTRACT

A dual dispenser having two pumps and an outlet channel that is fed with the fluids coming from both pumps. The two pumps include respective actuator rods that are movable axially over strokes of different lengths, namely a first actuator rod having a long stroke, and a second actuator rod having a short stroke. The common dispenser head includes a pivot member that forms two bearing elements that are constrained to move together, so as to move both actuator rods simultaneously over an axial height that corresponds to the short stroke, with one bearing element then continuing its movement so as to terminate its long stroke by pivoting and turning the pivot member about the bearing element that is blocked in position as a result of the second actuator rod already being fully depressed.

11 Claims, 3 Drawing Sheets

(58) Field of Classification Search
USPC ..... 222/135
See application file for complete search history.

(56) References Cited

U.S. PATENT DOCUMENTS

| | | | | |
|---|---|---|---|---|
| 6,454,135 | B1 * | 9/2002 | Brozell | B05B 11/3011 222/135 |
| 7,021,499 | B2 * | 4/2006 | Hansen | A47L 13/00 222/135 |
| 7,195,135 | B1 * | 3/2007 | Garcia | B05B 11/3084 222/137 |
| 7,290,681 | B2 * | 11/2007 | Decottignies | B05B 11/0078 222/135 |
| 7,798,366 | B2 * | 9/2010 | Hoshino | B65D 83/62 222/105 |
| 9,579,676 | B1 * | 2/2017 | Burrowes | B05B 15/55 |
| 2004/0238567 | A1 * | 12/2004 | Bloc | B05B 11/3084 222/135 |
| 2017/0065993 | A1 * | 3/2017 | Burrowes | B05B 11/3047 |

FOREIGN PATENT DOCUMENTS

| | | | |
|---|---|---|---|
| FR | 2 654 016 | A | 5/1991 |
| WO | 2012/031687 | A1 | 3/2012 |
| WO | 2015/191490 | A1 | 12/2015 |

OTHER PUBLICATIONS

International Preliminary Report on Patentability with English translation of Written Opinion dated Mar. 22, 2018 in counterpart international application No. PCT/FR2016/052240.

* cited by examiner

DUAL DISPENSER

CROSS REFERENCE TO RELATED APPLICATIONS

This application is a National Stage of International Application No. PCT/FR2016/052240, filed on Sep. 8, 2016, which claims priority from French Patent Application No. 1558351, filed on Sep. 9, 2015.

The present invention relates to a dual dispenser comprising two different fluid reservoirs, two pumps, and a common dispenser head, the common dispenser head including an outlet channel that forms a dispenser orifice, the outlet channel being fed with fluids coming from both pumps. Advantageous fields of application of the present invention are the fields of cosmetics, pharmacy, and perfumery.

In the prior art, dual dispensers that are capable of dispensing two different fluids coming from distinct reservoirs through a single common dispenser orifice have been known for some time. Document FR 2 654 016 is an example: it describes a dual dispenser including a rotary spacer that is movable above the actuator rod of one of the pumps so as to vary the extent to which the actuator rod is depressed, and thus vary the dose to be mixed with the dose expelled by the other pump.

An object of the present invention is not to vary the dose to be dispensed by the pumps by acting on the stroke of one of the actuator rods, but rather to offset the dispensing of the fluids at the end of stroke, so that only one fluid is dispensed through the dispenser orifice at the end of the dispensing stage. In other words, outside the dispensing stage, the dispenser orifice is in contact with only one fluid, or indeed the dispenser orifice is in contact with both fluids only during dispensing stages.

To achieve this object, the present invention proposes a dual dispenser comprising two pumps that are associated respectively with two different fluid reservoirs, and a common dispenser head, the common dispenser head including an outlet channel that forms a dispenser orifice, the outlet channel being fed with the fluids coming from both pumps; wherein:

- the two pumps include respective actuator rods that are movable axially over strokes of different lengths, namely a first actuator rod having a long stroke, and a second actuator rod having a short stroke; and
- the common dispenser head includes a pivot member that forms two bearing elements that are constrained to move together, so as to move both actuator rods simultaneously over an axial height that corresponds to the short stroke, with one bearing element then continuing its movement so as to terminate its long stroke by pivoting/turning the pivot member about the bearing element that is blocked in position as a result of the second actuator rod already being fully depressed.

Thus, from the rest position of the common dispenser head, both bearing elements begin by following paths that are identical, symmetrical, and synchronous, and then, when the second actuator rod having a short stroke is fully depressed, the bearing elements cause the pivot member to pivot/turn, such that the bearing element associated with the first actuator rod having a long stroke continues to follow its axial path until the first actuator rod is fully depressed. It is preferable for the actuation forces of the two actuator rods to be substantially or completely identical. Otherwise, it would be necessary to provide axial guide means in order to enable both bearing elements to move in identical, symmetrical, and synchronous manner.

According to an advantageous characteristic of the invention, both bearing elements are secured to the outlet channel. Still more preferably, both bearing elements extend on either side of the outlet channel, advantageously in symmetrical manner. By way of example, the outlet channel may be rectilinear over at least a fraction of its length, and both bearing elements may extend symmetrically and oppositely from the channel.

In another advantageous aspect of the invention, both bearing elements pivot about the outlet channel. This causes the outlet channel to turn a little about its own axis, since it acts as a pivot pin for both bearing elements.

In another advantageous aspect of the invention, the pivot member may include at least one thrust transmission zone, and advantageously two thrust transmission zones, such that axial thrust exerted on the thrust transmission zone causes both bearing elements and the outlet channel to begin by moving in translation over the short stroke, and then causes the outlet channel to turn a little about its own axis and the bearing elements to pivot so as to terminate the long stroke. In other words, the outlet channel and its two bearing elements move firstly in translation over the short stroke, and then they pivot about the contact point of the bearing element that is in abutment against the second actuator rod that is fully depressed. The bearing element associated with the first actuator rod continues its downward movement, not in translation, but, on the contrary, describing an arc of a circle having a radius that corresponds to the spacing between the contact points of the two bearing elements. The outlet channel also describes a circular arc, but with a radius that is smaller, namely half the radius of the arc of the bearing elements.

According to another advantageous characteristic of the invention, the common dispenser head includes a cover that comes into bearing contact against the thrust transmission zones. Advantageously, the outlet channel includes a thrust transmission zone in the proximity of each of its ends. Advantageously, the bearing elements extend substantially perpendicularly to the outlet channel, between the two thrust transmission zones. Forming two thrust transmission zones makes it possible to distribute the thrust in balanced manner over the length of the outlet channel, and positioning the transmission zones at the ends of the channel makes it possible to keep the channel completely stable while it is moving.

In a very advantageous aspect, the first actuator rod having the long stroke may be connected to the outlet channel closer to the dispenser orifice than the second actuator rod having the short stroke. Thus, the fluid coming from the first actuator rod (having a long stroke) passes alone and last through the dispenser orifice during each dispensing stage, such that in the rest position, there is only the fluid coming from the first actuator rod at the dispenser orifice. This is particularly advantageous when the fluid coming from the second actuator rod is sensitive, "denaturable", or "deterioratable" on contact with air. By using a fluid (coming from the first actuator rod) that is more stable and/or that has disinfectant or bactericidal properties, it is guaranteed that there will be no contaminated or spoilt fluid residue at the dispenser orifice.

In a practical embodiment, each actuator rod may be covered by a cap that defines both a bearing plate for its respective bearing element, and also a connection endpiece that receives a flexible hose that is connected to the outlet channel. The cap may be merely force-fitted on the free end of the actuator rod.

The spirit of the invention resides in the principle of actuating both pumps by means of a rotary member that begins by moving in translation over the stroke common to both pumps, and then turns or pivots so as to terminate the actuation of the pump that has the longer stroke. Thus, at the end of the dispensing stage, one of the pumps continues to dispense fluid after the other pump so as to expose the dispenser orifice, and a section of the outlet channel, to only one fluid, that advantageously has stable, disinfectant, and/or bactericidal properties.

The invention is described below in greater detail with reference to the accompanying drawings, which show an embodiment of the invention by way of non-limiting example.

IN THE FIGURES

Figure 1:
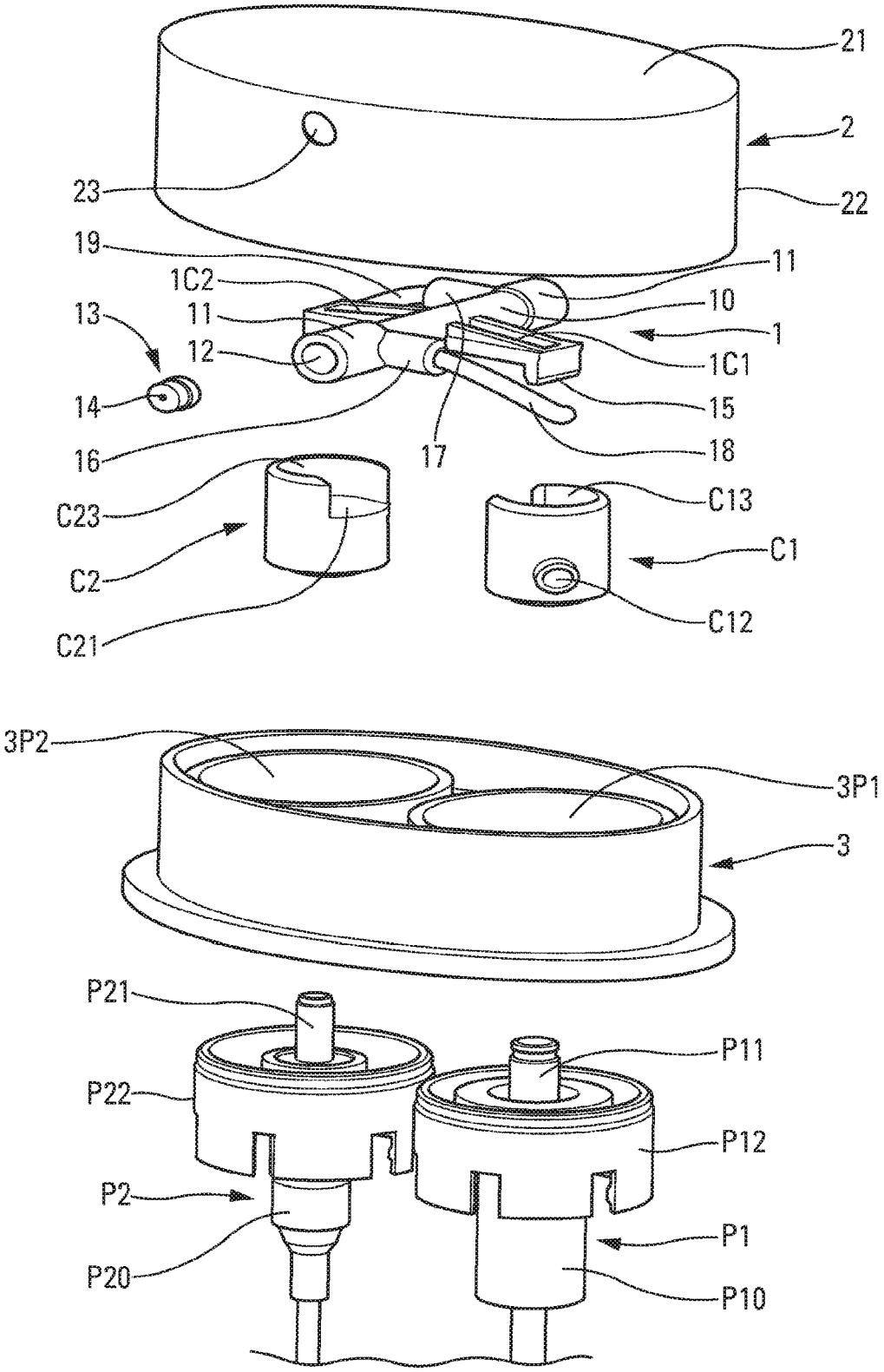
FIG. 1 is an exploded perspective view of a dispenser of the present invention, the two reservoirs not being shown.
Figure 2:
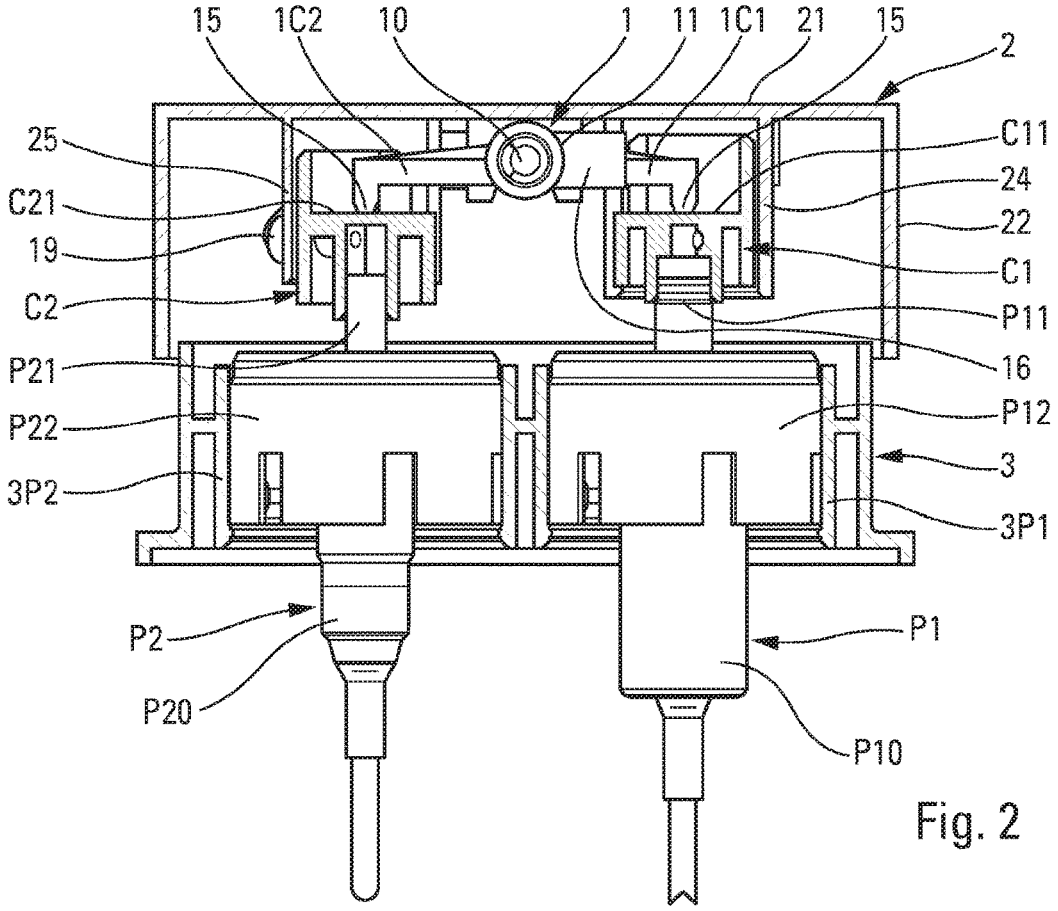
FIG. 2 is a vertical section view through the FIG. 1 dispenser in its assembled state and in its rest position, and in the absence of any reservoirs.
Figure 3:
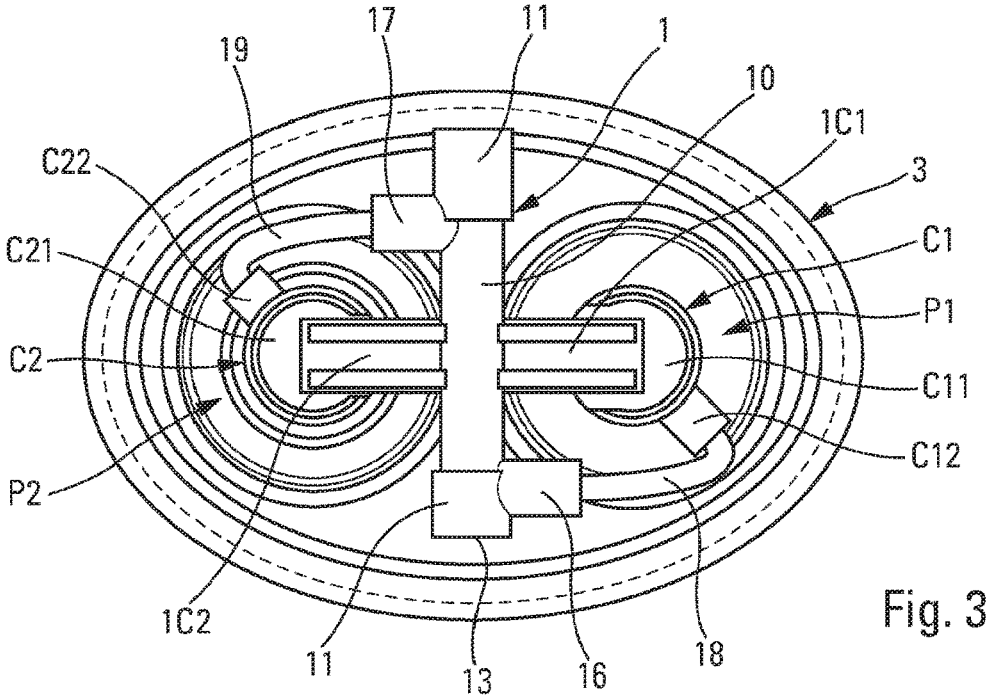
FIG. 3 is a transparent plan view of FIG. 2.

Reference is made to FIGS. 1 to 3 independently, in order to describe in detail the structure of a dual dispenser of the invention that is suitable for dispensing two fluids of different natures, textures and/or properties simultaneously. The entire dispenser is described with the exception of the two fluid reservoirs containing the different fluids. An optional shell containing the two reservoirs is not shown either. In any event, the two reservoirs and the shell are not critical to the present invention that lies in the top portion of the dispenser.

Thus, the dispenser of the invention includes two pumps P1 and P2, each including a respective pump body P10 and P20 and two respective actuator rods P11 and P21 that are movable axially down and up in the corresponding pump bodies P10 and P20 against respective return springs that are not shown. The actuator rods P11 and P21 that project upwards out from the bodies P10 and P20 are movable over strokes of heights that are different, namely a long stroke for the actuator rod P11 and a shorter stroke for the actuator rod P21. Each of the pumps P1 and P2 defines a respective pump chamber, which pump chambers are of volumes that may be identical or different.

In addition, it may be advantageous for both actuator rods P11 and P21 to present press resistance that is substantially or completely identical. If not, it would be necessary, in the context of the invention, to envisage specific means to compensate for any difference in press resistance between the two actuator rods.

Each pump P1, P2 also includes a fastener ring P12, P22 for mounting the pump in stationary and leaktight manner on the neck of a corresponding reservoir (not shown). The type of fastening is not critical to the present invention.

The dual dispenser of the invention also includes a support ring 3 that defines two reception housings 3P1 and 3P2 for the pumps P1 and P2 respectively. As can be seen in FIG. 2, the fastener rings P12 and P22 are received as tight fits inside the two reception housings 3P1 and 3P2, so as to lock the rings on the necks of the reservoirs. This configuration is entirely conventional in the field of cosmetics. The support ring 3 may co-operate with a shell (not shown) in which the two reservoirs (not shown) are received.

The dual dispenser of the invention also includes two caps C1 and C2 that cap the free ends of the actuator rods P11 and P21 respectively, as can be seen in FIG. 2. The caps C1 and C2 may be identical or they may be a little different, e.g. so as to fit on actuator rods of different diameters. Each cap C1, C2 includes a bearing plate C11, C21 and a lateral connection endpiece C12, C22. Each connection endpiece communicates directly with its actuator rod P11, P21, such that the fluids forced through the actuator rods reach the respective connector endpiece C12, C22. The bearing plates C11, C21 extend substantially perpendicularly to the movement axis of the actuator rods P11, P21. Advantageously, each bearing plate is surrounded in part by a notched collar C13, C23.

The dual dispenser of the invention also includes a pivot member 1 that may advantageously be made as a single part. The pivot member 1 includes an outlet channel 10 that, in this embodiment, presents a rectilinear configuration. The outlet channel 10 is closed at one of its ends and, at its other end, it defines an opening 12 into which there is fitted a nozzle 13 that defines a dispenser orifice 14. Thus, the fluid that arrives in the outlet channel 10 leaves through the dispenser orifice 14 of the nozzle 13 that closes the opening 12. It should also be observed that both ends of the channel 10 are reinforced in such a manner as to define two thrust transmission zones 11, as explained below. The outlet channel 10 includes two connector endpieces 16, 17 each of which receives a flexible hose 18, 19, connected to the connector endpieces C12, C22 respectively of the caps C1 and C2. The flexible hoses 18 and 19 may be fitted into the endpieces 16, 17, C12, and C22, or, in a variant, they may be made integrally either with the pivot member 1 or with the caps C1 and C2. In FIG. 3, it can be seen more clearly how the flexible hoses 18 and 19 connect together the endpieces 16 & C12 and 17 & C22, by presenting a bent configuration. In FIGS. 1 and 3, it should be observed that the endpiece 16 is arranged in the proximity of the nozzle 13, and thus of the dispenser orifice 14, while the connector endpiece 17 is situated in the proximity of the end remote from the nozzle 13. Consequently, the fluid coming from the pump P1 and travelling through the cap C1 and the flexible hose 18 is injected into the outlet channel 10 in the direct proximity of the dispenser orifice 14. In contrast, the fluid coming from the pump P2 passes along the entire length of the duct of the outlet channel 10.

The pivot member 1 also forms two bearing elements 1C1 and 1C2 that extend perpendicularly to the outlet channel 10 in symmetrical and opposite manner. It could be said that the outlet channel 10 and the two bearing elements 1C1 and 1C2 present a configuration that is generally in the shape of a cross. As a result, the two bearing elements 1C1 and 1C2 are secured to each other by means of the outlet channel 10. Each bearing element is in the form of an elongate tab that, at its free end, defines a bearing head 15 that points downwards, and that comes into contact with the bearing plate C11, C21 of a corresponding cap C1, C2, as shown in FIG. 2. The bearing elements 1C1 and 1C2 extend through the notches of the notched collars C13 and C23 so as to enable the respective bearing heads 15 to come into contact with the bearing plates C11, C21. Advantageously, the bearing heads 15 extend in alignment with the actuator rods P11, P21. It should also be observed that the bearing elements 1C1 and 1C2 are connected to the outlet channel 10, substantially mid-way between the two thrust transmission zones 11 that are situated at the two opposite ends of the channel 10.

The dual dispenser of the invention also includes a cover 2 that, in this embodiment, is of a shape that is oval, and that defines a top bearing surface 21 and a peripheral skirt 22 that is perforated with a hole 23 that comes to face the nozzle 13. The cover 2 also includes a holder bushing 24 in which the cap C1 is received in stationary manner. In addition, the cover 2 also includes a guide bushing 25 that surrounds the cap C2, enabling it to slide therein. As can be seen in FIG. 2, the skirt 22 of the cover 2 extends around the support ring 3 in such a manner as to mask the caps C1, C2 and the dispenser and bearing member 1 completely.

The two caps C1 and C2, the pivot member 1, and the cover 2 co-operate with one another to form a fluid dispenser head that is common to both pumps P1 and P2.

Figure 4:
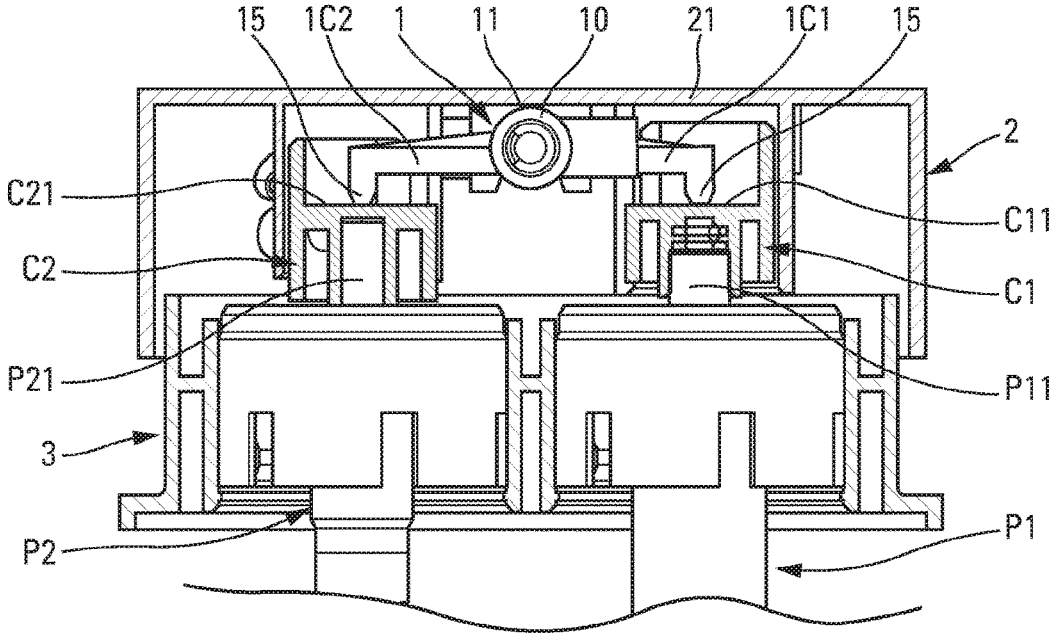
FIG. 4 is a view similar to the view in FIG. 2, after the dispenser head has performed the short stroke.

In FIG. 2, the dispenser is in its rest configuration with both actuator rods P11 and P21 in their positions in which they are maximally extended out from the respective pump bodies P10, P20. Both bearing plates C11 and C21 are situated at substantially or exactly the same height. Naturally, the same applies for the respective bearing heads 15 of the two bearing elements 1C1 and 1C2. The bottom face of the bearing surface 21 of the cover 2 is in contact with the outlet channel 10 at the two thrust transmission zones 11. From this rest position, the user may use one or more fingers to press on the bearing surface 21 of the cover 2 with a thrust force that is sufficient to move the cover 2 towards the support ring 3. The thrust exerted in this way on the cover 2 is transmitted to the outlet channel 10 via the two thrust transmission zones 11. The thrust force then passes through both thrust elements 1C1 and 1C2 to the bearing heads 15 that are in bearing contact against the bearing plates C11 and C21. The thrust then passes to the actuator rods P11 and P21 that are constrained to be pressed into the respective pump bodies P10 and P20. As a result of the actuator rods P11 and P21 presenting press resistance that is identical or almost identical, and as a result of the bearing elements 1C1 and 1C2 being symmetrically identical, both actuator rods P11 and P21 are pressed down simultaneously until the actuator rod P21, which has the shorter stroke, is fully depressed. This intermediate and instantaneous position is shown in FIG. 4. Both actuator rods P11 and P21 have thus performed the same stroke, namely the short stroke that is the maximum stroke of the actuator rod P21. The different fluids coming from the two pumps P1 and P2 have thus traveled simultaneously and in parallel through the respective actuator rods P11, P21, the respective caps C1, C2, and the respective flexible hoses 18, 19 so as to reach the inside of the outlet channel 10 where the two fluids are mixed together before being dispensed through the single common dispenser orifice 14. Both fluids are dispensed simultaneously from the rest configuration in FIG. 2 to the intermediate configuration in FIG. 4.

The user who continues to exert a thrust force on the bearing surface 21 moves the cover 2 further downwards, transmitting thrust to the pivot member 1 via both thrust transmission zones 11 of the outlet channel 10. Given that the head 15 of the bearing element 1C2 is blocked in position as a result of the actuator rod P21 being fully depressed, the thrust transmitted to the outlet channel 10 causes additional downward movement of the bearing head 15 of the bearing element 1C1. This causes the actuator rod P11 to be depressed fully, such that it performs its complete long stroke. During this additional stroke, fluid coming from the pump P1 is injected into the outlet channel 10 and then through the dispenser orifice 14. It should be observed that only the fluid coming from the pump P1 passes through the dispenser orifice 14 at the end of the dispensing stage, since dispensing of the other fluid coming from the pump P2 finishes once the actuator rod P21 has performed its entire short stroke.

Figure 5:
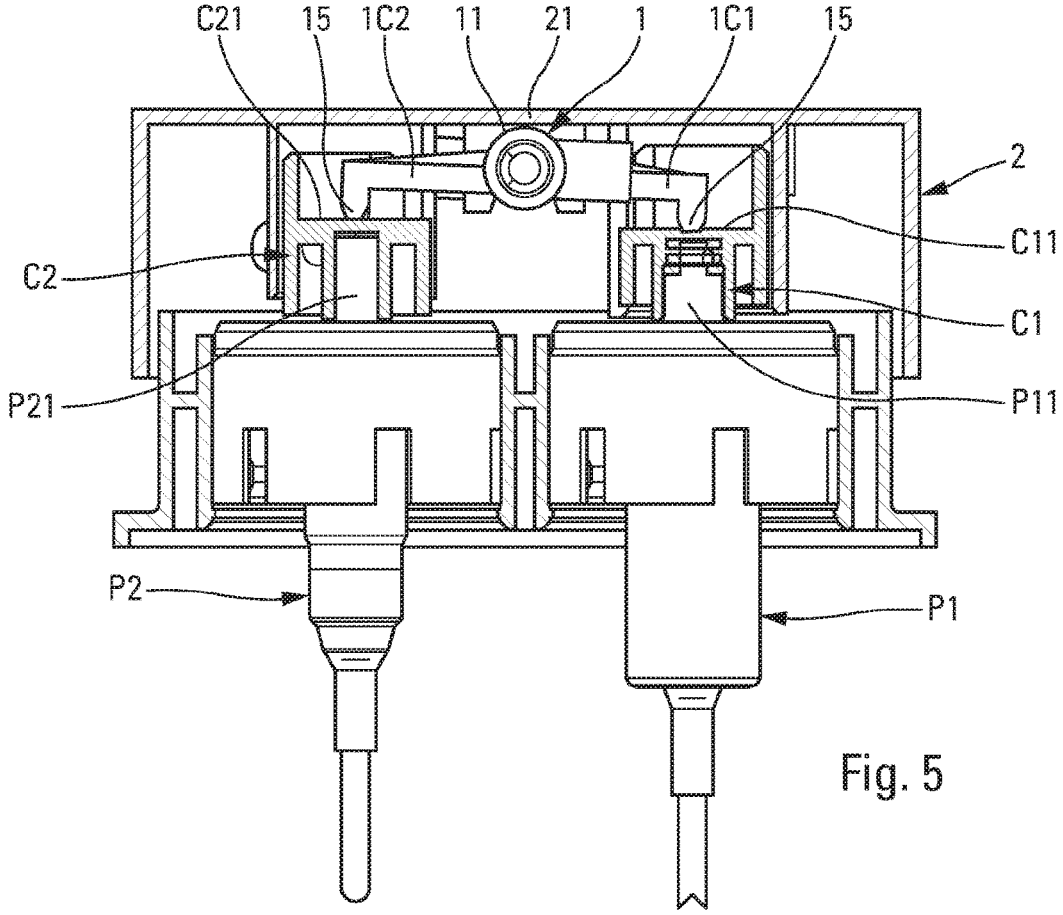
FIG. 5 is a view similar to the view in FIG. 4, after the dispenser head has performed the long stroke.

By comparing FIGS. 4 and 5, it can be seen that the orientation of the two bearing elements 1C1 and 1C2 has changed. Specifically, in FIG. 4, both bearing elements 1C1 and 1C2 extend in a plane that is substantially horizontal, while in FIG. 5, the same bearing elements extend in a plane that slopes a little towards the right. Consequently, with reference to the cover 2, the bearing elements 1C1 and 1C2 have pivoted or turned a little about the contact point of the bearing head 15 that bears against the bearing plate C21. The same applies for the outlet channel 10 that has correspondingly pivoted a little. In contrast, with reference to the outlet channel 10, it can be said that the outlet channel (10) has turned a little about its own axis, and the bearing elements (1C1, 1C2) have pivoted about the outlet channel (10) so as to terminate the long stroke.

As a result of only the pump P1 dispensing fluid at the end of the dispensing stage, the fluid coming from the pump P2 can be eliminated when the dispenser is in its rest position. Thus, the fluid coming from the pump P2 is present at the dispenser orifice 14 only while dispensing is taking place, and even then not throughout a dispensing stage, since at the end of the dispensing stage only the fluid coming from the pump P1 passes through the dispenser orifice 14. It should also be recalled that the fluid coming from the pump P1 is injected into the outlet channel 10 in the proximity of the nozzle 13, via the connector endpiece 16, as can be seen in FIG. 3. This implies that, at the end of the dispensing stage, a very small quantity of fluid coming from the pump P1 is sufficient to eliminate the fluid coming from the pump P2 from the dispenser orifice 14. In the rest position, as shown in FIG. 4, the fluid coming from the pump P2 fills almost all of the outlet channel 10, with the exception of its end next to the nozzle 13.

The dual dispenser of the present invention is particularly advantageous for dispensing two fluids of different natures and/or properties. For example, the fluid dispensed by the pump P2 could be a fluid that is sensitive or that degrades easily, while the fluid dispensed by the pump P1 could be a fluid that is more stable, less fragile, or that presents bactericidal or disinfectant properties. By way of example, provision could be made for the pump P1 to dispense an alcohol solution. Thus, at the end of each dispensing stage, the dispenser orifice 14 is cleaned by passing a tiny dose of alcohol solution that ensures that the nozzle 13 is properly cleaned.

The invention thus provides a dual dispenser having a dispenser orifice that cannot be the seat of a proliferation of microbes or of bacteria that could be harmful to the user or to the fluids that are dispensed.

What is claimed is:

1. A dual dispenser comprising two pumps that are associated respectively with two different fluid reservoirs, and a dispenser head, the dispenser head including an outlet channel that forms a dispenser orifice, the outlet channel being fed with the fluids coming from both pumps;

wherein:

the two pumps include respective actuator rods that are movable axially over strokes of different lengths, namely a first actuator rod having a long stroke, and a second actuator rod having a short stroke; and the dispenser head includes a pivot member that forms two bearing elements that are constrained to move together, so as to move both actuator rods simultaneously over an axial height that corresponds to the short stroke, with one bearing element then continuing movement so as to terminate the long stroke by pivoting and turning the pivot member about the bearing element that is blocked in position as a result of the second actuator rod already being fully depressed.

2. A dispenser according to claim 1, wherein both bearing elements are secured to the outlet channel.

3. A dispenser according to claim 1, wherein both bearing elements extend on either side of the outlet channel.

4. A dispenser according to claim 1, wherein both bearing elements pivot about the outlet channel.

5. A dispenser according to claim 1, wherein the pivot member includes at least one thrust transmission zone, such that axial thrust exerted on the thrust transmission zone causes both bearing elements and the outlet channel to begin by moving in translation over the short stroke, and then causes the outlet channel to turn a little about its own axis and the bearing elements to pivot so as to terminate the long stroke.

6. A dispenser according to claim 5, wherein the dispenser head includes a cover that comes into bearing contact against the thrust transmission zones.

7. A dispenser according to claim 6, wherein the outlet channel includes a thrust transmission zone in the proximity of each end.

8. A dispenser according to claim 7, wherein the bearing elements extend substantially perpendicularly to the outlet channel, between the two thrust transmission zones.

9. A dispenser according to claim 1, wherein the first actuator rod having the long stroke is connected to the outlet channel closer to the dispenser orifice than the second actuator rod having the short stroke.

10. A dispenser according to claim 1, wherein each actuator rod is covered by a cap that defines both a bearing plate for the respective bearing element, and also a connection endpiece that receives a flexible hose that is connected to the outlet channel.

11. A dispenser according to claim 1, wherein both bearing elements extend symmetrical on either side of the outlet channel.

* * * * *